US011247310B2

(12) United States Patent
Chen

(10) Patent No.: US 11,247,310 B2
(45) Date of Patent: Feb. 15, 2022

(54) RATCHET WRENCH

(71) Applicant: FINE FORGE INDUSTRY CORPORATION, Nantou County (TW)

(72) Inventor: Kuo-Lung Chen, Nantou County (TW)

(73) Assignee: FINE FORGE INDUSTRY CORPORATION, Nantou County (TW)

( * ) Notice: Subject to any disclaimer, the term of this patent is extended or adjusted under 35 U.S.C. 154(b) by 351 days.

(21) Appl. No.: 16/287,768

(22) Filed: Feb. 27, 2019

(65) Prior Publication Data

US 2020/0269393 A1 Aug. 27, 2020

(51) Int. Cl.
*B25B 13/46* (2006.01)
*B25B 23/00* (2006.01)

(52) U.S. Cl.
CPC ..... *B25B 13/463* (2013.01); *B25B 13/46* (2013.01); *B25B 13/462* (2013.01); *B25B 23/0035* (2013.01)

(58) Field of Classification Search
CPC ... B25B 13/46; B25B 23/0035; B25B 13/462; B25B 23/10; B25B 13/463; B25B 13/465; B25B 13/481; B25B 13/468; B25G 3/02
USPC ..... 81/63.1, 59.1, 60, 61; 192/44
See application file for complete search history.

(56) References Cited

U.S. PATENT DOCUMENTS

2018/0318989 A1* 11/2018 Lin ..... B25B 23/10

FOREIGN PATENT DOCUMENTS

| | | | | |
|---|---|---|---|---|
| EP | 2633953 A1 * | 9/2013 | ..... | B25B 13/463 |
| TW | I623388 B | 5/2018 | | |
| TW | I628051 B | 7/2018 | | |

* cited by examiner

*Primary Examiner* — Katina N. Henson
(74) *Attorney, Agent, or Firm* — Muncy, Geissler, Olds & Lowe, P.C.

(57) ABSTRACT

A ratchet wrench is provided, including a main body, a lever member, a ratchet head, a switch assembly and a cover assembly. The cover assembly includes a lid member and a positioning member. The positioning member is embedded within a grooved portion of the main body so that the lid member is positioned to the main body. A surface of the lid member is flush with a surface of the main body.

10 Claims, 9 Drawing Sheets

RATCHET WRENCH

BACKGROUND OF THE INVENTION

Field of the Invention

The present invention relates to a ratchet wrench.

Description of the Prior Art

A conventional ratchet wrench, as disclosed in Taiwan Patent Number 1628051 and 1623388, includes a main body, a ratchet member, a lid member and a lever member. The ratchet member is rotatably received within a head portion of the main body, and the lever member is switchable to change the rotational direction of the ratchet member. The lid member is used to blockably restrict the ratchet member within a compartment of the head portion of the main body.

However, the lid member of the conventional ratchet wrench is usually attached to the head portion of the main body by screwing. The head portion has to be provided with at least one threaded hole, which causes a weight of the head portion of the main body to be heavier and the compartment for receiving the ratchet member to be decreased. Therefore, the compartment can only receive the ratchet member with smaller dimensions. Structural strength of the ratchet member with smaller dimensions is insufficient. In addition, a threaded structure of a screw is easy to be broken after repeatedly assembling and disassembling the screw, which causes that the lid member cannot restrict the ratchet member within the compartment of the main body.

The present invention is, therefore, arisen to obviate or at least mitigate the above-mentioned disadvantages.

SUMMARY OF THE INVENTION

The main object of the present invention is to provide a ratchet wrench, in which a lid member of the ratchet wrench is easy to be assembled and a ratchet head of the ratchet wrench can be preferably restricted therewithin.

To achieve the above and other objects, the present invention provides a ratchet wrench, including: a main body, a lever member, a ratchet head, a switch assembly and a cover assembly. The main body includes a head portion and a handle portion. The head portion defines a first compartment and a second compartment which are communicated with each other. Two opposite sides of the head portion are respectively defined as an operational surface and as a working surface. The first compartment is disposed through the operational surface, and the second compartment is disposed through the working surface. The lever member includes a driving portion and a lever portion which are connected with each other. The driving portion is rotatably inserted within the first compartment, and the lever portion is swingable relative to the operational surface about the driving portion. The ratchet head is rotatably received within the second compartment. The ratchet head includes an annular toothed portion. The switch assembly includes a detent and a switch member. The detent is movably received within the second compartment, and a toothed structure of the detent is engaged with the annular toothed portion of the ratchet head. Two ends of the switch member are respectively connected with the detent and the driving portion so that the lever member and the switch assembly are cooperatively movable with each other. The cover assembly includes a lid member and a positioning member. The lid member includes a base, a supporting portion and a plurality of restricting portions which are spaced apart from one another. The base has a through hole and includes a first surface and a second surface which spacingly correspond to each other. The supporting portion protrudes, in a radial direction of the through hole, beyond a periphery of the first surface of the base. The plurality of restricting portions protrude, in the radial direction of the through hole, beyond a periphery of the second surface of the base. The positioning member is disposed between the supporting portion and the plurality of restricting portions and engaged with the base. The positioning member is embedded within a grooved portion of the second compartment so that the lid member is positioned to the head portion and covers the second compartment, wherein the lid member is flush with the working surface.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
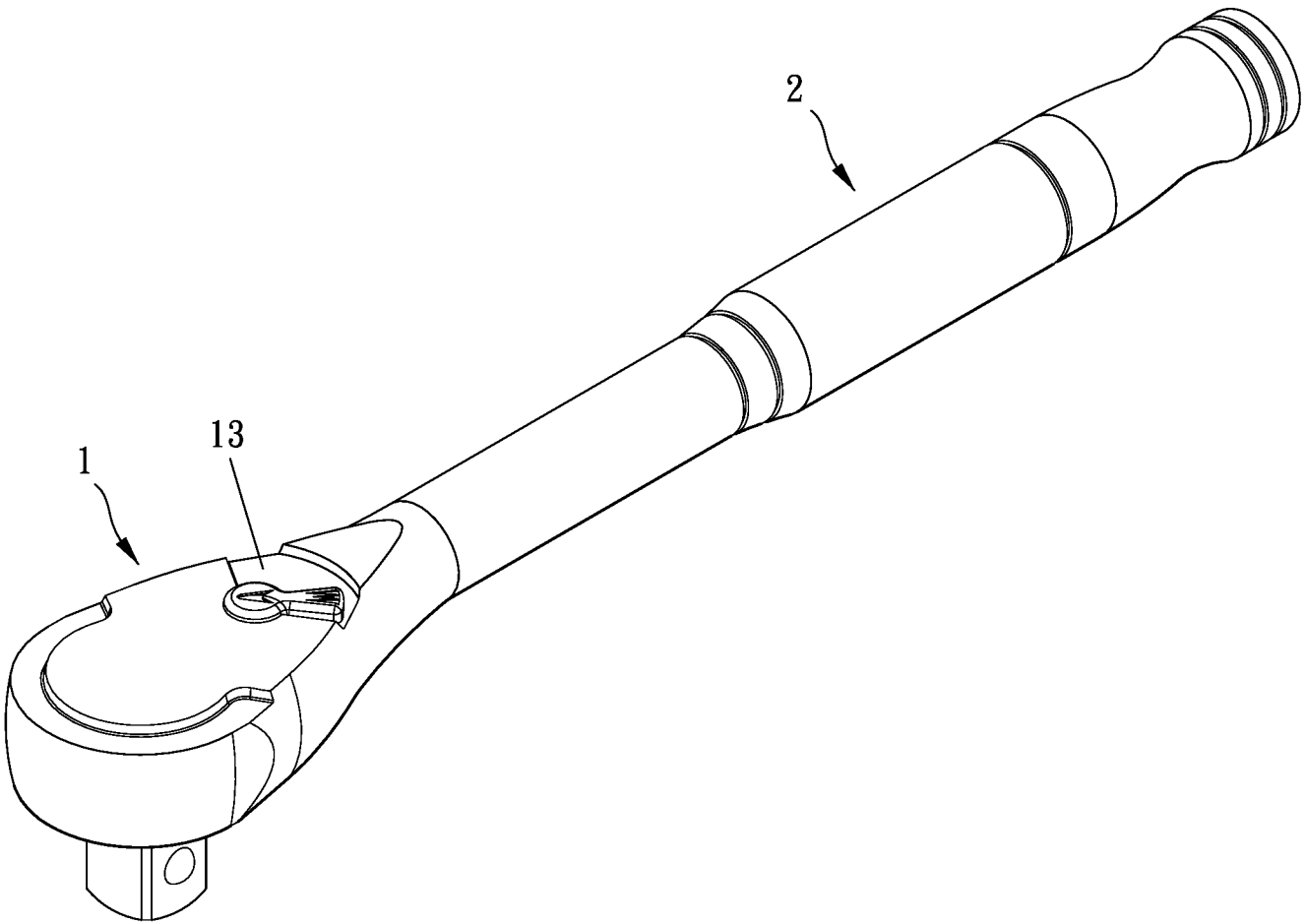
FIG. 1 is a stereogram of a preferable embodiment of the present invention.
Figure 2:
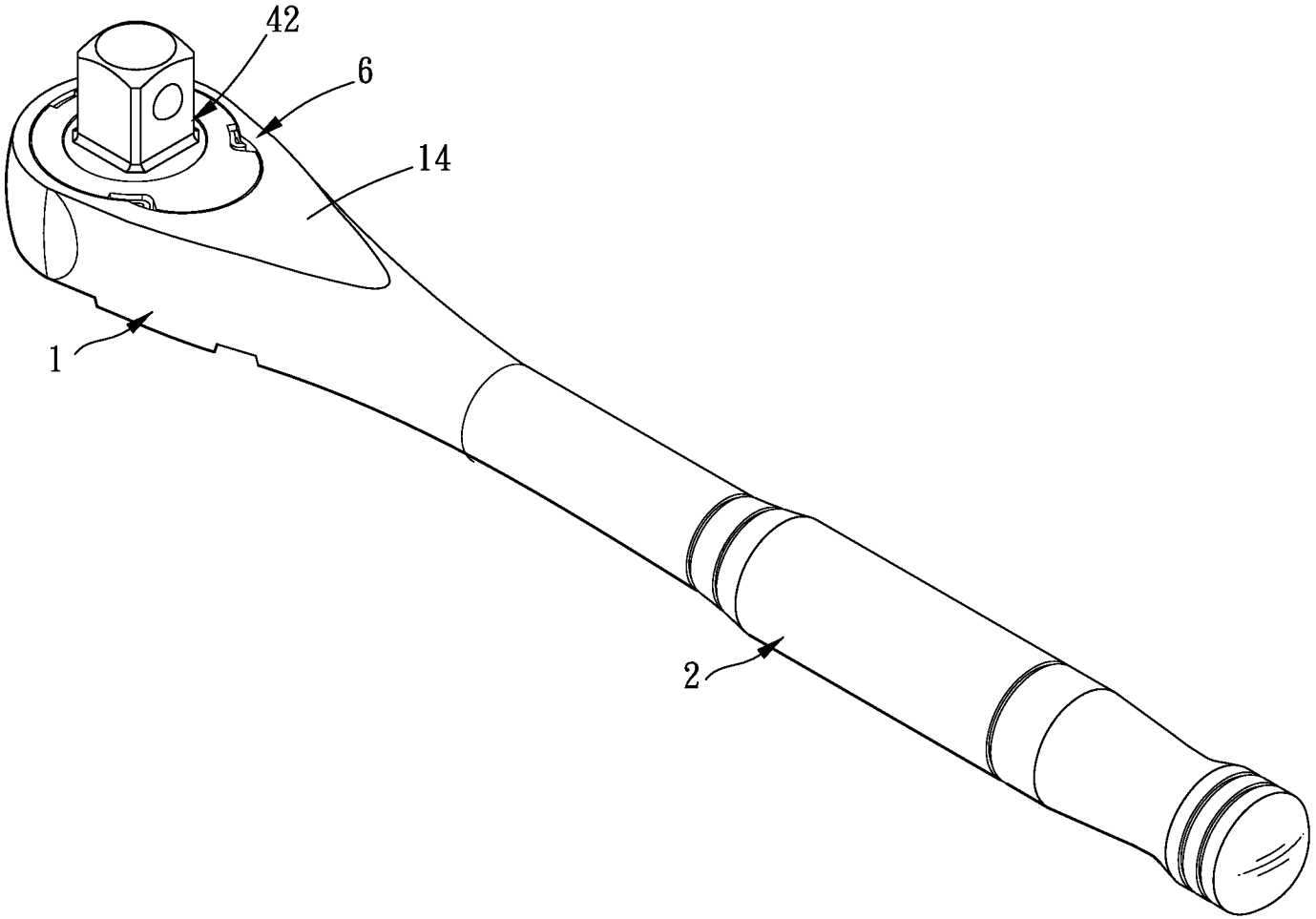
FIG. 2 is another stereogram of FIG. 1.
Figure 3:
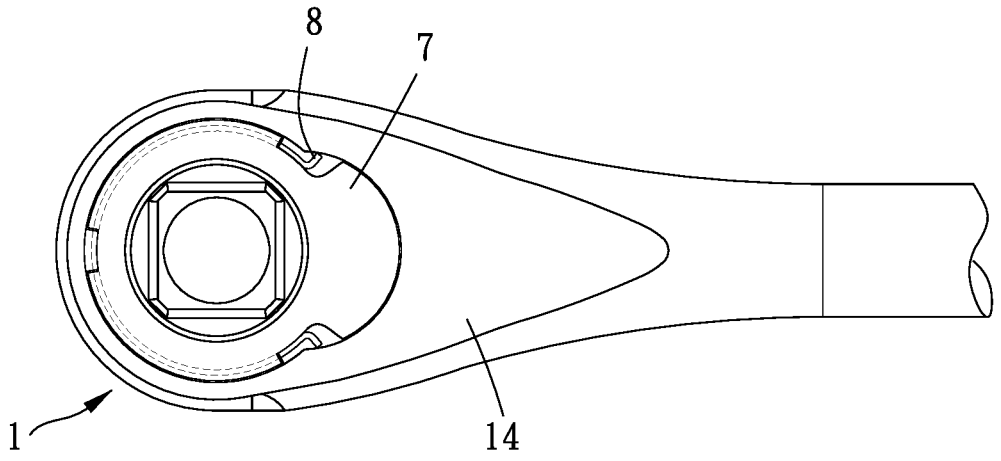
FIG. 3 is a top view of FIG. 2.
Figure 4:
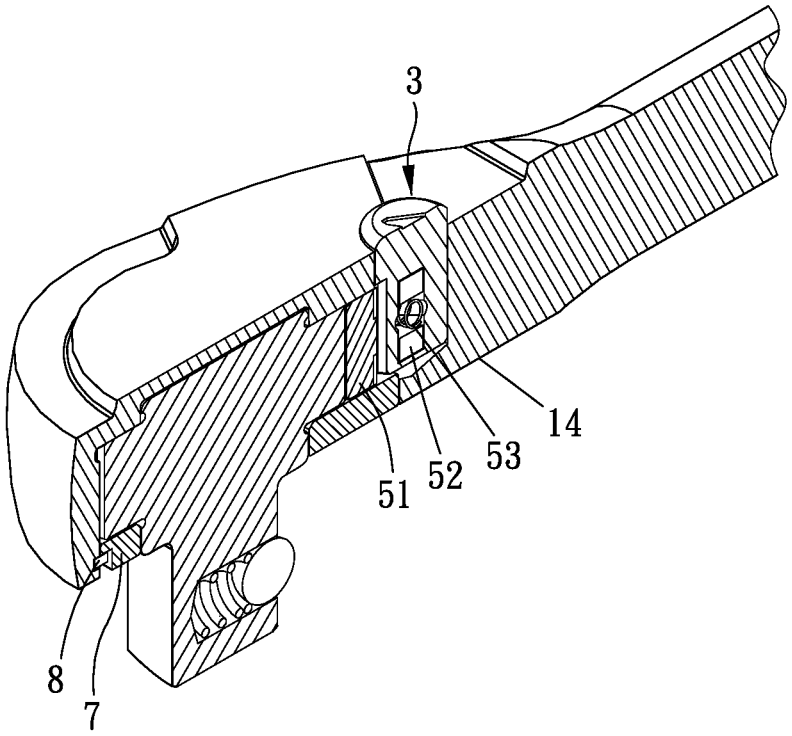
FIG. 4 is a partial cross-sectional view of FIG. 1.
Figure 5:
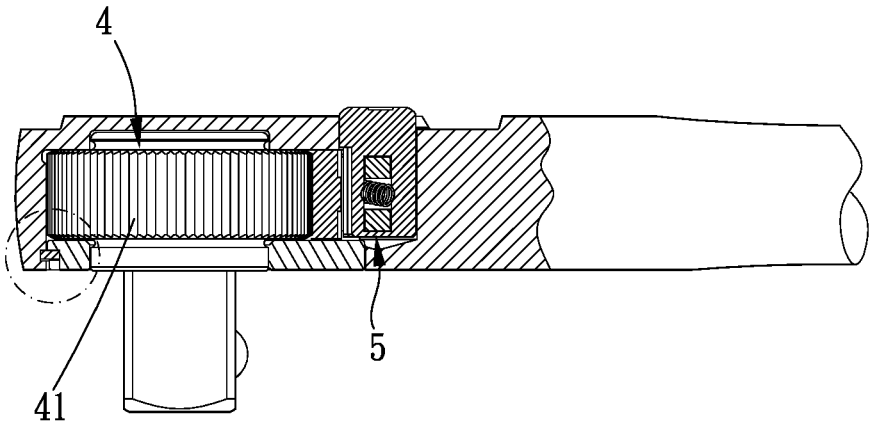
FIG. 5 is a partial cross-sectional side view of FIG. 1.
Figure 6:
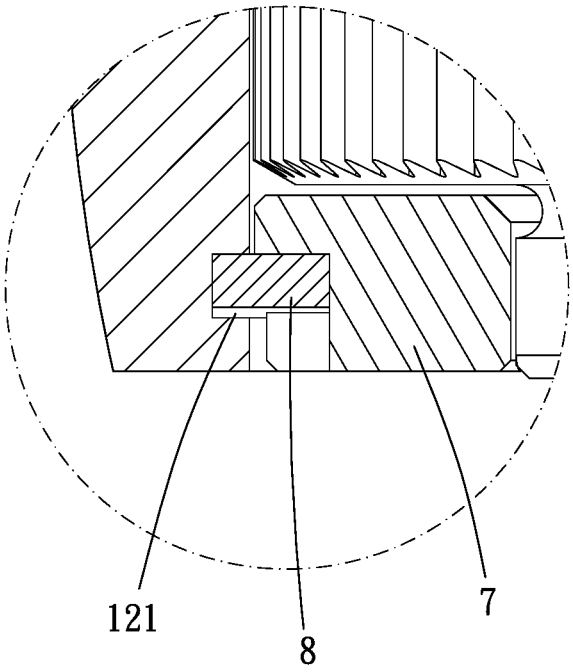
FIG. 6 is a partial enlargement of FIG. 5.
Figure 7:
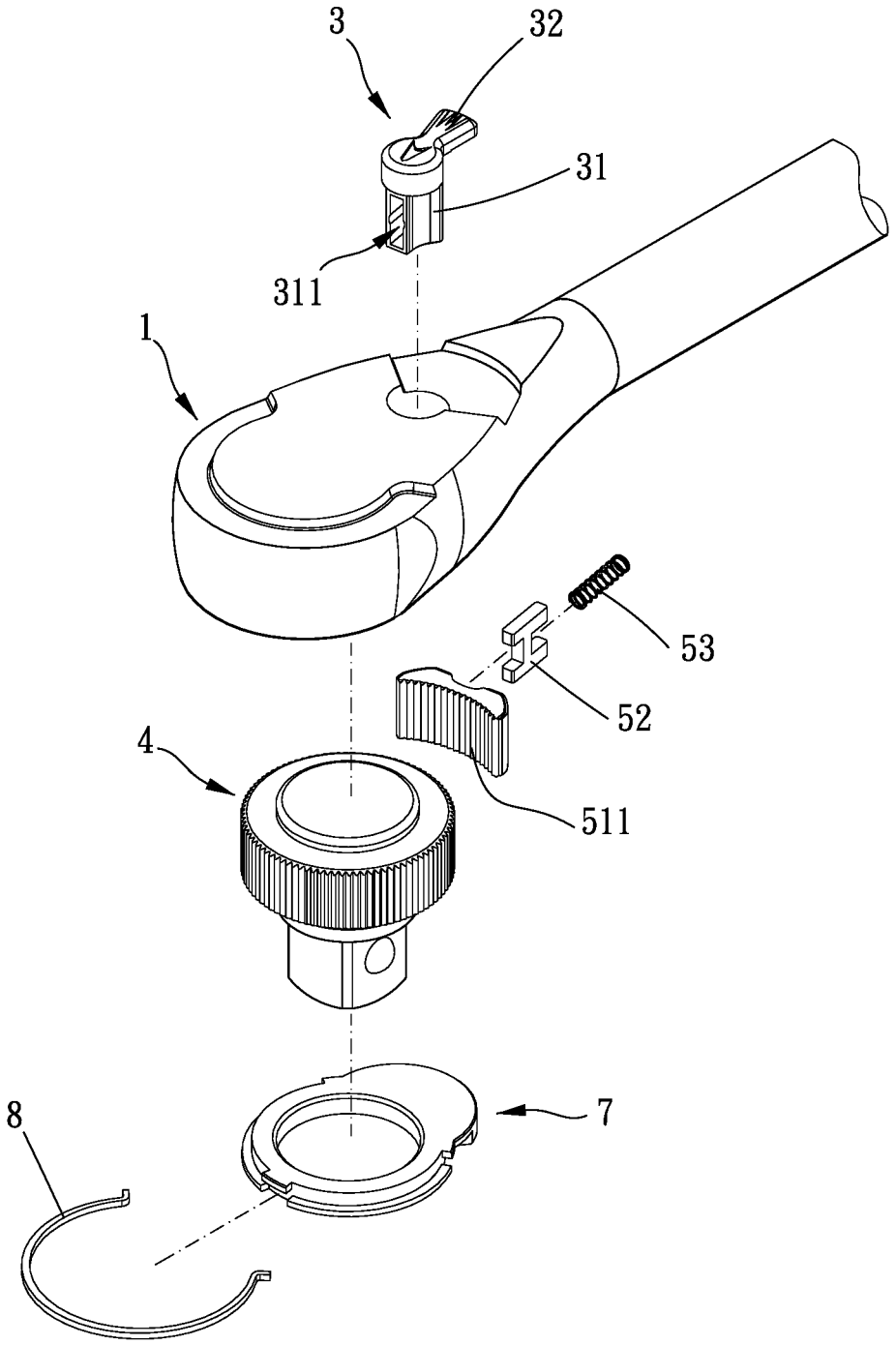
FIG. 7 is a breakdown drawing of FIG. 1.
Figure 8:
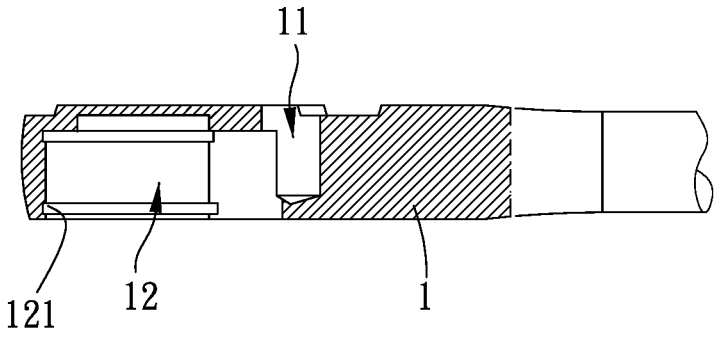
FIG. 8 is a partial cross-sectional side view of a main body of FIG. 7.
Figure 9:
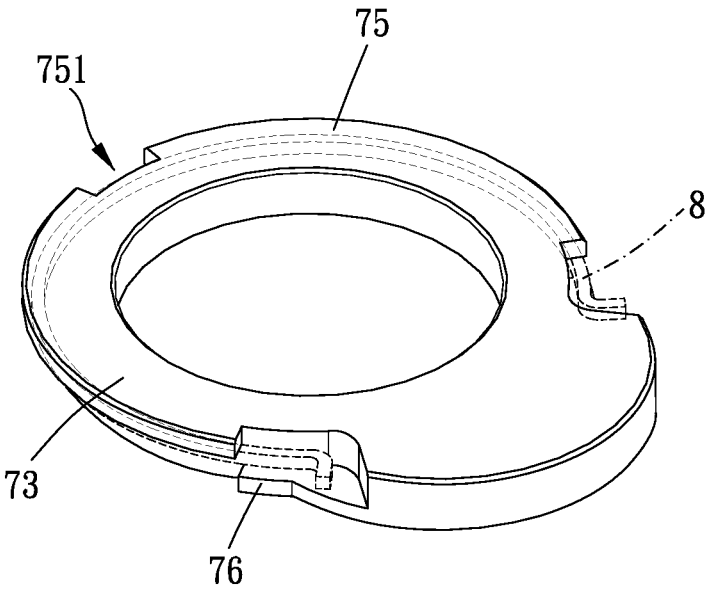
FIG. 9 is a stereogram of a cover assembly of a preferable embodiment of the present invention.
Figure 10:
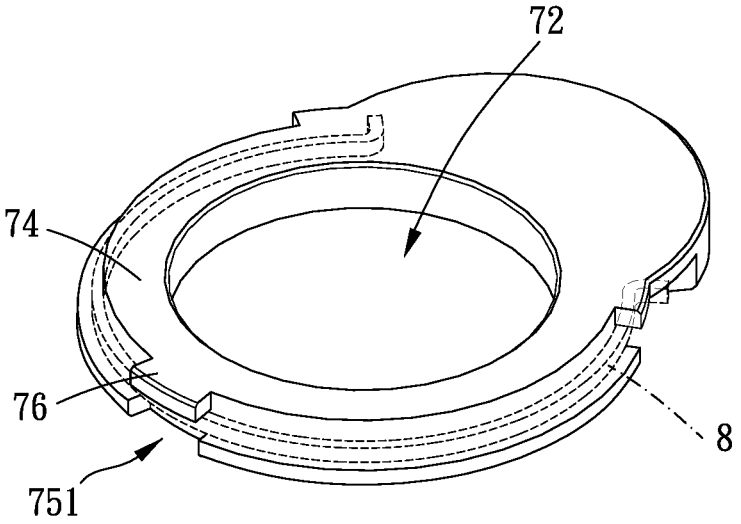
FIG. 10 is another stereogram of FIG. 9.
Figure 11:
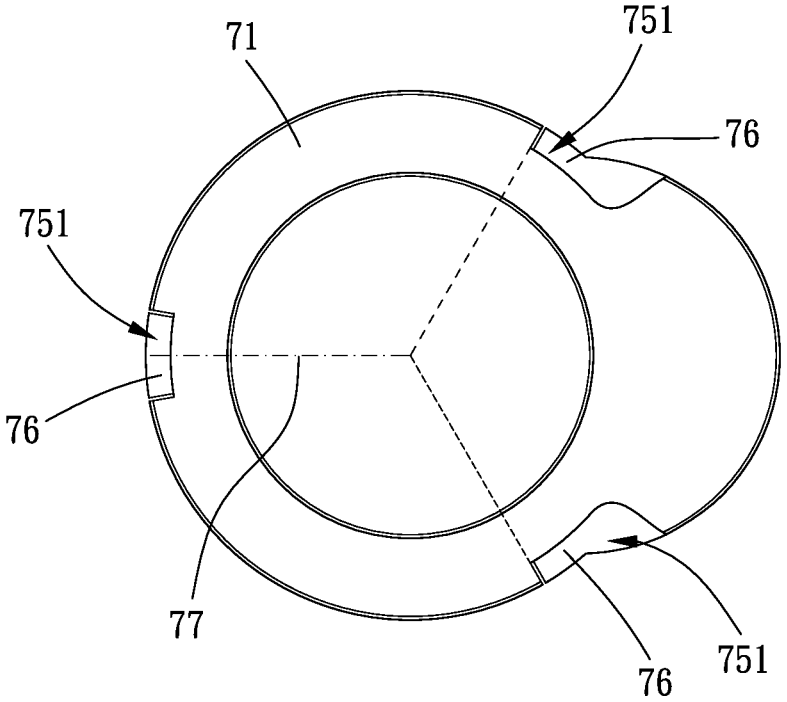
FIG. 11 is a top view of a lid member of FIG. 9.
Figure 12:
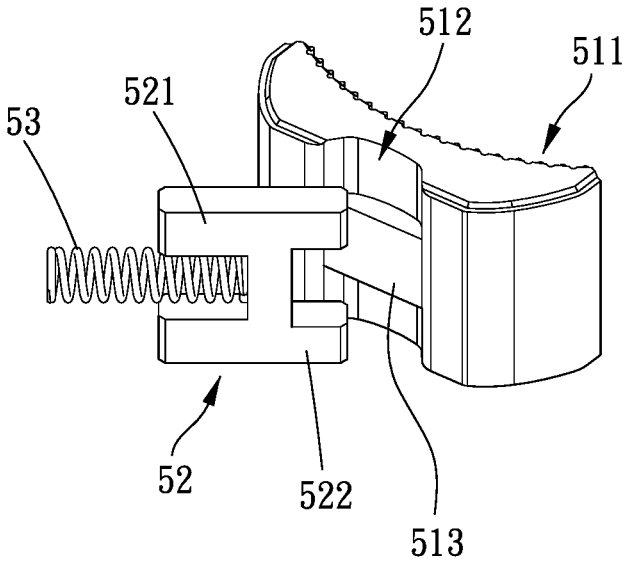
FIG. 12 is a breakdown drawing of a switch member and a detent of a preferable embodiment of the present invention.
Figure 13:
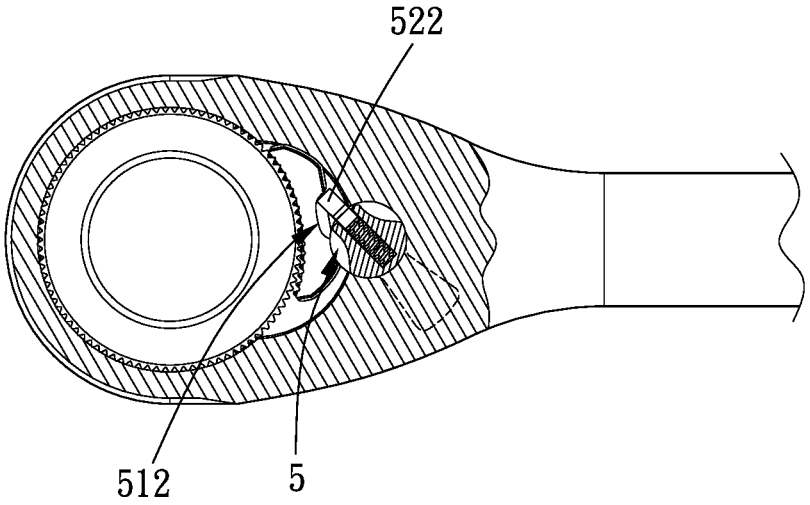
FIGS. 13 and 14 are schematic diagrams of the switch member of a preferable embodiment of the present invention in operation.
Figure 14:
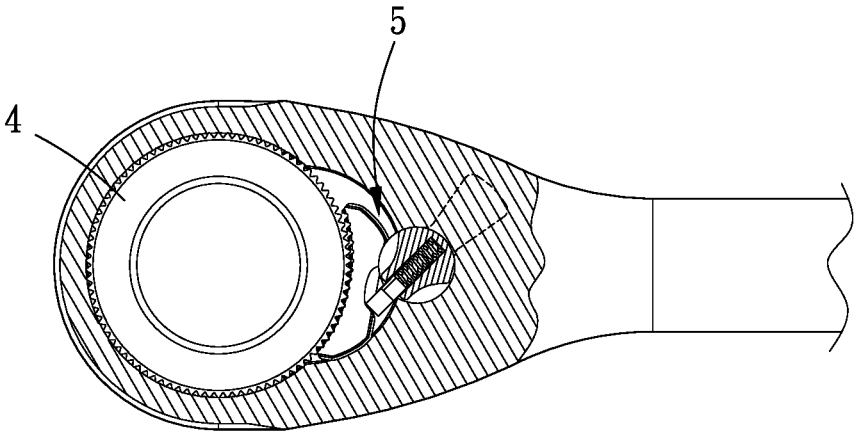

Please refer to FIGS. 1 to 14 for a preferable embodiment of the present invention. A ratchet wrench of the present invention includes a main body, a lever member 3, a ratchet head 4, a switch assembly 5 and a cover assembly 6.

The main body includes a head portion 1 and a handle portion 2. The head portion 1 defines a first compartment 11 and a second compartment 12 which are communicated with each other, and two opposite sides of the head portion 1 is respectively defined as an operational surface 13 and as a working surface 14. The first compartment 11 is disposed through the operational surface 13, and the second compartment 12 is disposed through the working surface 14. The lever member 33 includes a driving portion 31 and a lever portion 32 which are connected with each other. The driving portion 31 is rotatably inserted within the first compartment 11, and the lever portion 32 is swingable relative to the operational surface 13 about the driving portion 31.

The ratchet head 4 is rotatably received within the second compartment 12. The ratchet head 4 includes an annular toothed portion 41. The switch assembly 5 includes a detent 51 and a switch member 52. The detent 51 is movably received within the second compartment 12, and a toothed structure 511 of the detent 51 is engaged with the annular toothed portion 41 of the ratchet head 4. Two ends of the switch member 52 are respectively connected with the detent 51 and the driving portion 31 so that the lever member 33 and the switch assembly 5 are cooperatively movable with each other.

In operation, the lever portion 32 is moved to drive the driving portion 31 to be rotated, and the driving portion 31 brings the switch member 52 to push the detent 51 so as to change the rotational direction of the ratchet head 4.

The cover assembly 6 includes a lid member 7 and a positioning member 8. The lid member 7 includes a base 71, a supporting portion 75 and a plurality of restricting portions 76 which are spaced apart from one another. The base 71 has a through hole 72 and includes a first surface 73 and a second surface 74 which spacingly correspond to each other. The ratchet head 4 further includes a driving head 42 (such as D head), and the driving head 42 protrudes beyond the through hole 72 and is configured to be assembled with an object. The supporting portion 75 protrudes, in a radial direction of the through hole 72, beyond a periphery of the first surface 73 of the base 71. The plurality of restricting portions 76 protrudes, in the radial direction of the through hole 72, beyond a periphery of the second surface 74 of the base 71. The positioning member 8 is disposed between the supporting portion 75 and the plurality of restricting portions 76 and engaged with the base 71. The positioning member 8 is embedded within a grooved portion 121 of the second compartment 12 so that the lid member 7 is positioned to the head portion 1 and covers the second compartment 12, which prevents foreign objects from getting into the second compartment 12 and ensures that components disposed in the second compartment 12 can operate smoothly.

According to configurations described above, the lid member 7 is assembled without any screw, which can effectively reduce an amount of material required for the head portion 1 and achieves the purpose of light weigth of the head portion 1. In addition, the second compartment 12 has a larger space to receive the ratchet head 4 with larger size or special specification for preferable structural strength of the ratchet head 4 and broad practicality. Through a positioning method of embedding the positioning member 8 within the grooved portion 121, a position of the grooved portion 121 on the second compartment 12 is easy to be controlled during processing, with a known thickness of the lid member 7, the lid member 7 can be accurately configured to be flush with the working surface 14, which increases assembling quality of the head portion 1.

The plurality of restricting portions 76 are spaced apart from one another so as to reduce manufacturing cost and easily configure an outer ring space with the supporting portion 75 to receive the positioning member 8. In addition, a structure of the configuration described above is beneficial for subsequent process, for example but not be limitated thereto, the lid member 7 with the plurality of restricting portions 76 is easier to be demolded during a molding process of the lid member 7, and spaces disposed between the plurality of restricting portions 76 are configured for a tool (such as a cutter head) to reach to a preferable operation position during processing (such as polishing and deburring).

Specifically, the supporting portion 75 has a plurality of apertures 751 disposed therethrough, and a number of the plurality of apertures 751 is equal to a number of the plurality of restricting portions 76. The plurality of apertures 751 correspondingly face to the plurality of restricting portions 76 in an axial direction of the through hole 72. With the structure described above, the lid member 7 is easy to be demolded during manufacturing. In this embodiment, contours of the plurality of restricting portions 76 are complementary to contours of the plurality of apertures 751.

As viewed in the axial direction of the through hole 72, a center of one of the plurality of apertures 751 and an axle center of the through hole 72 are located on a linear phantom line 77, and another two of the plurality of apertures 751 are symmetrically arranged relative to the linear phantom line 77. In this embodiment, three apertures 751 are disposed through the supporting portion 75, and the three apertures 751 define an isosceles triangle. Specifically, relative to the axle center of the through hole 72, a center of a first one of the three apertures 751 and respective edges of a second one and a third one of the three apertures 751 are equiangularly arranged at 120 degrees.

In assembling, the first surface 73 faces away from the second compartment 12 and is flush with the working surface 14. Opening directions of the plurality of apertures 751 are backward to the second compartment 12 and part of the positioning member 8 is revealed out of the ratchet wrench. The second surface 74 faces toward the second compartment 12 and blockably restricts the ratchet head 4. In this embodiment, the positioning member 8 is a C-shaped retainer which is elastically embedded within the grooved portion 121, and the lid member 7 is easy to be disassembled by pressing two ends of the C-shaped retainer through two of the apertures 751.

The switch assembly 5 preferably further includes an elastic member 53. An end of the elastic member 53 is positioned on the driving portion 31 and another end of the elastic member 53 is positioned on the switch member 52, and the elastic member 53 biases the switch member 52 toward the detent 51 for a preferable co-movement relation.

Moreover, a side of the detent 51 facing to the ratchet head 4 has the toothed structure 511, and a side of the detent 51 faceing away from the ratchet head 4 has a notch 512. The switch member 52 is inserted within the notch 512 so as to bring the detent 51 to move. The switch member 52 includes two first abutting legs 521 and two second abutting legs 522. The two first abutting legs 521 are spacingly disposed on a side of the switch member 52, and the two second abutting legs 522 are spacingly disposed on another side of the switch member 52. The two first abutting legs 521 are inserted within the driving portion 31, and the two second abutting legs 522 are inserted within the notch 512. The elastic member 53 is located between the two first abutting legs 521. In this embodiment, the driving portion 31 defines an insertion space 311. An opening of the insertion space 311 faces toward the second compartment 12, and parts of the two first abutting legs 521 and part of the elastic member 53 are received within the insertion space 311.

Furthermore, the switch member 52 is H-shaped. Respective one of the two first abutting legs 521 is thicker than respective one of the two second abutting legs 522 so that the driving portion 31 has a large contact area with the two first abutting legs 521 during rotation. Each of the two second abutting legs 522 is thinner for reducing a contact area with the detent 51, and a friction between the switch member 52 and the detent 51 is reduced when the switch member 52 is swung relative to the detent 51 for smooth swinging and prompt response of the switch member 52. A distance between the two second abutting legs 522 is larger than a distance between the two first abutting legs 521 so that the two second abutting legs 522 are preferably inserted within the notch 512 and stably biased against the detent 51 to move. In this embodiment, a beam 513 is disposed within the notch 512, and the two second abutting legs 522 protrude into the notch 512 and are located respectively at two sides of the beam 513. In a direction transverse to the beam 513, the beam 513 further restricts the two second abutting legs 522 so that the two second abutting legs 522 are unmovable relative to the detent 51 and undepartable from the detent 51.

In summary, the lid member can be rapidly assembled and positioned to the head portion by the positioning member to cover the second compartment, which prevents foreign objects from getting into the second compartment and interfering rotation of the ratchet head. The lid member is easy to be configured to be flush with the working surface during processing so as to increase assembling quality. In addition, the switch member with H-shaped can have a prompt response in operation, which increases an operator's using experience.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A ratchet wrench, including:

a main body, including a head portion and a handle portion, the head portion defining a first compartment and a second compartment which are communicated with each other, two opposite sides of the head portion being respectively defined as an operational surface and as a working surface, the first compartment being disposed through the operational surface, the second compartment being disposed through the working surface;

a lever member, including a driving portion and a lever portion which are connected with each other, the driving portion being rotatably inserted within the first compartment, the lever portion being swingable relative to the operational surface about the driving portion;

a ratchet head, being rotatably received within the second compartment, including an annular toothed portion;

a switch assembly, including a detent and a switch member, the detent being movably received within the second compartment, a toothed structure of the detent being engaged with the annular toothed portion of the ratchet head, two ends of the switch member being respectively connected with the detent and the driving portion so that the lever member and the switch assembly are cooperatively movable with each other;

a cover assembly, including a lid member and a positioning member, the lid member including a base, a supporting portion and a plurality of restricting portions which are spaced apart from one another, the base having a through hole and including a first surface and a second surface which spacingly correspond to each other in an axial direction of the through hole, the supporting portion protruding, in a radial direction of the through hole, beyond a periphery of the first surface of the base, the plurality of restricting portions protruding, in the radial direction of the through hole, beyond a periphery of the second surface of the base, the positioning member being disposed between the supporting portion and the plurality of restricting portions and engaged with the base, the positioning member being embedded within a grooved portion of the second compartment so that the lid member is positioned to the head portion and covers the second compartment, wherein the lid member is flush with the working surface.

2. The ratchet wrench of claim 1, wherein the supporting portion has a plurality of apertures disposed therethrough, a number of the plurality of apertures is equal to a number of the plurality of restricting portions, and the plurality of apertures correspondingly face to the plurality of restricting portions in the axial direction of the through hole.

3. The ratchet wrench of claim 1, wherein the switch assembly further includes an elastic member, an end of the elastic member is positioned on the driving portion, another end of the elastic member is positioned on the switch member, and the elastic member biases the switch member toward the detent.

4. The ratchet wrench of claim 1, wherein the ratchet head further includes a driving head, and the driving head protrudes beyond the through hole and is configured to be assembled with an object.

5. The ratchet wrench of claim 2, wherein as viewed in the axial direction of the through hole, a center of one of the plurality of apertures and an axle center of the through hole are located on a linear phantom line, and another two of the plurality of apertures are symmetrically arranged relative to the linear phantom line.

6. The ratchet wrench of claim 2, wherein the first surface faces away from the second compartment and is flush with the working surface, opening directions of the plurality of apertures are backward to the second compartment and part of the positioning member is revealed out of the ratchet wrench, the second surface faces toward the second compartment and blockably restricts the ratchet head.

7. The ratchet wrench of claim 3, wherein a side of the detent facing to the ratchet head has the toothed structure, a side of the detent faceing away from the ratchet head has a notch; the switch member includes two first abutting legs and two second abutting legs, the two first abutting legs are spacingly disposed on a side of the switch member, the two second abutting legs are spacingly disposed on another side of the switch member, the two first abutting legs are inserted within the driving portion, the two second abutting legs are inserted within the notch; the elastic member is located between the two first abutting legs.

8. The ratchet wrench of claim 7, wherein a beam is disposed within the notch, and the two second abutting legs protrude into the notch and are located respectively at two sides of the beam.

9. The ratchet wrench of claim 7, wherein the driving portion defines an insertion space, an opening of the insertion space faces toward the second compartment, parts of the two first abutting legs and part of the elastic member are received within the insertion space.

10. The ratchet wrench of claim 9, wherein three apertures are disposed through the supporting portion, a number of the plurality of apertures is equal to a number of the plurality of restricting portions, the three apertures correspondingly face to the plurality of restricting portions in the axial direction of the through hole; as viewed in the axial direction of the through hole, a center of one of the plurality of apertures and an axle center of the through hole are located on a linear phantom line, and another two of the plurality of apertures are symmetrically arranged relative to the linear phantom line; the first surface faces away from the second compartment and is flush with the working surface, opening directions of the plurality of apertures are backward to the second compartment and part of the positioning member is revealed out of the ratchet wrench, the second surface faces toward the second compartment and blockably restricts the ratchet head; a beam is disposed within the notch, and the two second abutting legs protrude into the notch and are located respectively at two sides of the beam; the ratchet head further includes a driving head, and the driving head protrudes beyond the through hole and is configured to be assembled with an object; the three apertures define an isosceles triangle; relative to the axle center of the through hole, a center of a first one of the three apertures and respective edges of a second one and a third one of the three apertures are equiangularly arranged at 120 degrees; the positioning member is a C-shaped retainer; contours of the plurality of restricting portions are complementary to contours of the plurality of apertures; the switch member is H-shaped, respective one of the two first abutting legs is thicker than respective one of the two second abutting legs; a distance between the two second abutting legs is larger than a distance between the two first abutting legs.

* * * * *